United States Patent [19]

Van Thyne et al.

[11] 4,026,730

[45] May 31, 1977

[54] NITRIDED MATERIALS

[75] Inventors: Ray J. Van Thyne, Oak Lawn; John J. Rausch, Antioch, both of Ill.

[73] Assignee: Surface Technology Corporation, Oak Lawn, Ill.

[22] Filed: Nov. 20, 1974

[21] Appl. No.: 525,447

Related U.S. Application Data

[63] Continuation-in-part of Ser. Nos. 324,641, Jan. 18, 1973, abandoned, and Ser. No. 324,769, Jan. 18, 1973, abandoned, and Ser. No. 324,680, Jan. 18, 1973, abandoned, said Ser. No. 324,641, is a continuation-in-part of Ser. No. 99,663, Dec. 18, 1973, abandoned, Ser. No. 324,769, , which is a continuation-in-part of Ser. No. 99,664, Dec. 18, 1970, abandoned.

[52] U.S. Cl. ..... 148/31.5; 75/134 N; 75/134 F; 75/134 V; 75/174; 148/32

[51] Int. Cl.[2] ..... C22C 27/02

[58] Field of Search ..... 75/134 N, 134 V, 134 F, 75/174; 148/13.1, 20.3, 31.5, 32, 133

[56] References Cited

UNITED STATES PATENTS

| | | | |
|---|---|---|---|
| 3,011,927 | 12/1961 | Zelezny | 148/13.1 X |
| 3,125,445 | 3/1964 | Lottridge | 75/174 |
| 3,161,949 | 12/1964 | Dickinson et al. | 29/182.5 |
| 3,549,427 | 12/1970 | Rausch et al. | 148/20.3 X |
| 3,549,429 | 12/1970 | Rausch et al. | 148/20.3 X |
| 3,679,494 | 7/1972 | Hill et al. | 148/20.3 |

FOREIGN PATENTS OR APPLICATIONS

| | | | |
|---|---|---|---|
| 6,812,592 | 3/1969 | Netherlands | 75/174 |

OTHER PUBLICATIONS

ITT Research Report IR Report–IR–718–7(III) Sept., 1967, pp. 51–56, 58–60, 65 & 67.

*Primary Examiner*—Arthur J. Steiner
*Attorney, Agent, or Firm*—Albert Siegel

[57] ABSTRACT

Nitrided cutting tool materials having excellent wear and abrasion resistance. Such materials consist essentially of an alloy base of (a) one or more metals of the group columbium and vanadium and sometimes tantalum; (b) hafnium; (c) one or more metals of the group molybdenum, tungsten, rhenium and chromium; and (d) optionally titanium and/or zirconium, all in amounts by weight as are set out in this specification. These alloys are formable to shape and are then nitrided to produce a nitrided gradient in a high hardness surface zone.

14 Claims, 2 Drawing Figures

NITRIDED MATERIALS

CROSS REFERENCE TO RELATED APPLICATIONS

This application is a continuation-in-part of our copending applications Ser. Nos. 324,641 "Nitrided Refractory Materials"; 324,769 "Nitrided Materials"; and 324,680 "Refractory Materials" all filed Jan. 18, 1973 and now abandoned. Ser. No. 324,641 in turn is a continuation-in-part of our Ser. No. 99,663 filed Dec. 18, 1970 and now abandoned. Ser. No. 324,769 in turn is a continuation-in-part of our Ser. No. 99,664 filed Dec. 18, 1970 and now abandoned.

BACKGROUND OF THE INVENTION

This invention relates to a group of novel nitrided cutting tool materials which are characterized by excellent wear and abrasion resistance. Such materials are formed upon the nitriding of various refractory metal alloys which are set out in this specification.

More specifically, the alloy base materials of our invention consist of the following in percentages by weight shown herein a. one or more metals of the group columbium and vanadium and optionally tantalum (herein "Group I");

b. hafnium;

c. one or more metals of the group molybdenum, tungsten, rhenium and chromium (hereinafter Group II); and d. optionally, one or more of the metals titanium and zirconium.

The amounts of these various metals to employ in fabricating the useful nitrided materials vary as a function of composition as will be seen herein.

When both titanium and zirconium are not present in these alloy systems the alloy base consists essentially of a. from 55% to 92% Cb and/or V with up to one-half of the content thereof being replaceable by Ta;

b. from 5% to 40% Hf; and c. from 2% to 40% of the Group II metals, provided, however, that maximum chromium content is 20%.

When the metal or metals titanium and zirconium are present in the alloy systems of this invention and when hafnium content is equal to or greater than the content thereof we find that the following compositional parameters provide useful cutting tool materials when nitrided:

a. from 55% to 85% of one or more metals of the group Cb and V, with up to one-half of the contnet thereof being replaceable by Ta;

b. from 5% to 35% hafnium;

c. at least 5% of Ti and/or Zr and wherein total hafnium, titanium and/or zirconium ranges from 10% to 40% with Ti and/or Zr being equal to or less than Hf content; and d. from 2% to 40% of one or more of the metals Mo, W, Re and Cr but maximum chromium content being 20%.

When the optional metal or metals titanium and zirconium are present in these alloy systems and when hafnium content is less than the content thereof we find that the following compositional parameters provide useful cutting tool materials when nitrided:

a. from 40% to 88% of one or more metals of the group Cb, Ta, V;

b. from 5% to slightly less than 20% hafnium;

c. such an amount of titanium and/or zirconium wherein total Hf, Ti and/or Zr ranges from 10% to 40% with hafnium content being less than Ti and/or Zr; and d. from 2% to 40% of one or more metals of Group II.

These tool materials have a nitrogen pick-up of at least 0.1 milligram per square centimeter of surface area. In the preferred embodiments hereof the nitrogen pick-up is at least 1.0 mg/cm$^2$ of surface area, and more preferably greater than 5.0 mg/cm$^2$.

Another aspect of our invention is directed to herein disclosed nitrided materials wherein up to 25% of the nitrogen is replaced by oxygen or boron or mixtures thereof.

In the present specification and claims, unless otherwise specifically noted, all compositional percentages are by weight.

We have found that the present nitrided materials are characterized by high surface hardness without accompanying brittleness and offer excellent utility as cutting tool materials.

DESCRIPTION OF THE PRIOR ART

In understanding the present invention and the background and significance thereof a number of writings which appear prior to the present invention should be considered. Several of said writings are represented by our prior patents or published applications. The present invention is directed to cutting tool materials different than those set out in our prior patents, published applications and such other writings hereinafter noted.

The nitriding of elemental tantalum or columbium is disclosed in Van Note, U.S. Pat. No. 2,170,844. There is also a very general reference that alloys consisting predominately of tantalum and columbium can be similarly treated. Such patent discloses that a two step process — hardening followed by diffusing — is required in the treatment of such metals and that the hardening must occur below 600° C (1110° F). The purpose of Van Note is stated to be the production of wear resistant articles such as spinnerets, bushings, extrusion jaws, hypodermic needles, etc., and other articles for use in the chemical and electrical industries.

In the present invention we have discovered that by the specific selection and concentration of alloying elements ternary, quaternary and higher columbium and vanadium rich alloys (and sometimes tantalum) can readily be provided to yield extremely good cutting tool materials upon nitriding.

Metals other than tantalum and columbium such as titaniumrich alloys, i.e., containing about 90% titanium, nitrided, were studied by E. Mitchell et al and reported in *J. Institute of Metals*, Vol. 93, p. 381 (1964). There is no suggestion of cutting tools therein and our own work with nitrided commercially available alloys Ti-6Al-4V and Ti-3Al-13V-13Cr shows that such nitrided materials lack utility as cutting tools. See our U.S. Pat. No. 3,677,832.

In our U.S. Pat. Nos. 3,549,427 "Wear Resistant Materials" and 3,549,429 "Wear and Abrasion Resistant Materials" we have disclosed and claimed certain nitrided alloy materials which are characterized by excellent cutting performance. The corresponding French patents were among the first to issue. Our French Pat. No. 1,584,635 (corresponding to U.S. Pat. No. 3,594,427) was published on Nov. 17, 1969. Our French Pat. No. 1,596,561 (corresponding to U.S. Pat. No. 3,549,429) was published on June 22, 1970. Our corresponding Dutch patent applications were the first to be made available to the public. Both such applications, Ser. Nos. 68.12592 and 68.12593 were published in keeping with Dutch practice on Mar. 7, 1969.

These patents and patent applications of ours are directed to nitrided alloys containing (a) one or more metals of the group columbium, tantalum and vanadium; (b) one or both metals molybdenum and tungsten; and (c) titanium and/or zirconium. Such patents and applications do not disclose the herein described hafnium containing materials.

Our U.S. Pat. No. 3,644,153 dated Feb. 22, 1972 is directed to a nitrided alloy system having utility, inter alia as cutting tools and composed of (a) columbium and/or tantalum and/or vanadium; (b) titanium and/or zirconium, (c) chromium and/or manganese and/or rhenium with optional additions of either molybdenum and/or tungsten. Again such patent does not disclose the nitrided composition of the present invention.

Three Research Reports of IIT Research Institute are of interest. These are Report IR-718-7(I) dated Aug. 22, 1967; Report IR-718(II) dated Sept. 7, 1967; and Report IR-718-7 (III) not clearly dated.

Report I discloses as cutting tools the nitrided materials Hf-50Ta, Hf-20Ta and Hf-22Ta-3Mo. Report II considers the same three compositions and adds Hf-30Ta to the listing. Report III in this series discloses nitrided, hafnium-rich materials and that such materials were useful as cutting tools. The report goes on to state that nitrided zirconiumrich 51Zr-46Ta-3Mo and 67.5Zr-30.5Cb-2Mo failed as cutting tools.

Such hafnium-rich, nitrided materials differ substantially from the present materials.

The nitriding of hafnium-containing alloys has been reported by D. J. Iden and L. Himmel — see Acta Met., Vol. 17, 0.1483 (1969) — and by F. Holtz — see ASTME Technical Paper MR 69–248 (1969). The alloys of Iden and Himmel were tungsten base, optionally containing rhenium and molybdenum and the hafnium content was below 3%. the authors were interested in studying internal nitriding characteristics and nothing is said regarding cutting tools. The compositions reported by Holtz are the same hafnium base materials of the IIT Reports. There are also reported in a DMIC Review of Recent Developments of Feb. 21, 1968 authored by J. F. Joyce.

Wyatt, U.S. Pat. No. 2,804,410 is directed to the nitriding of titanium and/or zirconium by heating such metals in the presence of ammonia. There results a continuous, relatively brittle surface that does not have utility as a cutting tool.

Hill et al U.S. Pat. No. 3,679,494 is directed to nitrided hafnium-tantalum alloys reported as useful for cutting tools. Such alloys consist of from 20% to 60% tantalum, 0 to 10% molybdenum, 0 to 10% tungsten, 0 to 1.5% boron, balance hafnium. The specification of such patent further generally recites that titanium and zirconium may be substituted for hafnium, but the reported evidence does not bear this out.

To the best of our knowledge such bare unsubstantiated and unclaimed statement of possible equivalency is not correct. In alloying or in the formation of hard compounds used in simple dispersion strengthening of alloys equivalency is generally assumed between the compounds of hafnium, titanium and zirconium but we have found that such equivalency does not exist over a broad compositional range in the complex nitriding reactions that result in the present material system. Hill et al show and claim that hafnium-rich materials, i.e., containing more than 50% Hf by weight, upon nitriding make useful cutting tool materials. As is set out in Tables I of our patents 3,549,427 and 3,549,429 we find that titanium-rich and zirconium-rich nitrided materials do not provide good cutting tools.

SUMMARY OF THE INVENTION

We have discovered a novel group of graded nitrided materials characterized by high surface hardness and useful wear resistance. These materials are formed when alloys within our prescribed compositional ranges as herein taught are reacted with nitrogen or an environment which is nitriding to the alloys at elevated temperatures. At the surface the volume or hard constituents formed and the nitrogen content is high in our materials unlike alloys dispersion strengthened by a relatively low volume of fine particles distributed essentially uniformly throughout. As nitrogen diffuses inwardly there is developed a variety of nitrided phases. Nitride formation and concentration lessen inwarly from the surface and this grading very significantly contributes to the excellent thermal and mechanical shock resistance that we find in our nitrided materials. Such materials are characterized by being graded with the degree of nitride formation lessening as one moves inwardly from the surface.

In one aspect of our invention at least a ternary or higher alloyed material is nitrided. When such species is used the alloy compositional limits are defined as follows:

a. from 55% to 92% Cb and/or V;

b. from 5% to 40% Hf; and c. from 2% to 40% of one or more metals of the group Mo, W, Re and Cr, with the maximum chromium content being 20%.

In other embodiments of such species up to one-half of the columbium and/or vanadium content may be replaced by tantalum. Thus tantalum content hereof may range from 0 to 46%.

In such species the three different groups of metallic constituents represent varying degrees of nitrideability and all composition are at least ternary or more complex to achieve the desired relative reactivity with nitrogen. Hafnium, which in this species most readily reacts with nitrogen and which forms the most stable nitride is present as a relatively minor constituent.

In another species of our invention, the novel cutting tool material consists essentially of a quaternary or higher alloyed nitrided alloy base of:

a. from 55% to 85% of one or more metals of the group Cb and V;

b. from 5% to 35% Hf;

c. titanium and/or zirconium wherein total hafnium, titanium and zirconium ranges from 10% to 40%, titanium and/or zirconium content is at least 5% and the titanium and/or zirconium content is equal to or less than hafnium content; and d. from 2% to 40% of one or more metals of the group Mo, W, Re and Cr, with the maximum chromium content being 20%.

In other embodiments of such species up to one-half of the columbium and/or vanadium content may be replaced by tantalum. Thus tantalum content of such species may range from 0 to 42.5%.

Here similarly and in the species considered infra the four different groups of metallic constituents represent varying degrees of nitrideability and all compositions are at least quaternary or more complex to achieve the desired relative reactivity with nitrogen. Hafnium, titanium and zirconium are the most reactive followed by the columbium group materials while the molybdenum group is quite relatively inert.

In still another species of our invention, the novel cutting tool material consists essentially of a quaternary or higher alloyed nitrided alloy base of:

a. from 40% to 88% of one or more metals of the group Cb, Ta and V;

b. hafnium;

c. titanium and/or zirconium wherein total hafnium, titanium and/or zirconium ranges from 10% to 40%, hafnium content ranges from 5% to slightly less than 20% and is less than of titanium and/or zirconium; and d. from 2% to 40% of one or more metals of the group Mo, W, Re and Cr with more specific compositional limits of this group in this particular species being set out in some detail below.

As noted above in some instances in the practice of the present invention a small portion, up to 25% by weight, of the nitrogen pick-up may be replaced by oxygen and/or boron, but the significance still lies in the basic nitriding which provides the bulk of the useful, hard phase.

A principal object of our invention is to provide a novel group of cutting tool materials having a graded, nitrided alloy base of materials selected as herein described.

This, and other objects, features and advantages of our invention will become apparent to those skilled in this art from the following detailed disclosure thereof and the accompanying drawings wherein.

EXPERIMENTAL PROCEDURES

Figure 1:
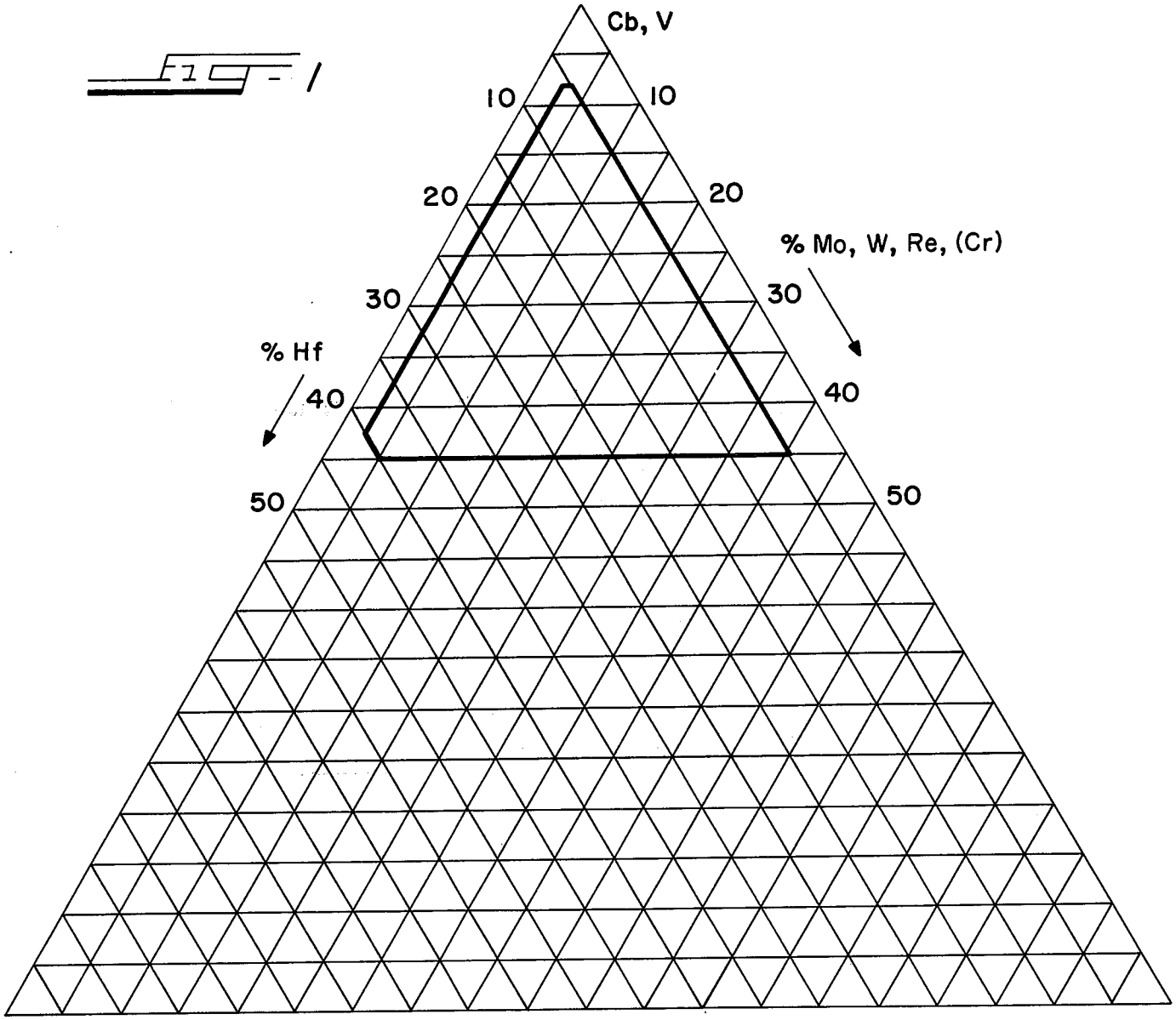
FIG. 1 is a ternary diagram of the compositions of a species useful herein. All materials of such species fall within the parameters of such polygon except that when chromium alone of its group is present, maximum chromium is 20% and thus the polygon would be somewhat smaller.

Before commencing a detailed discussion of our invention, the experimental procedures employed and criteria established to determine the usefulness of the present materials will be described.

In our experimental work a series of alloys were melted under an inert atmosphere in a non-consumable electrode arc furnace using a water-cooled, copper hearth. High purity materials (greater than 99.5%) were used for the alloy charges and generally weighed about 50 grams. These procedures are of course quite well known to those skilled in the art.

The alloys were cut into specimens approximately 1/8 inch thick and reacted in nitrogen at atmospheric pressure. The resulting thickness and microhardness of the various reaction zones or layers were determined using standard metallographic techniques. Several tests were used to evaluate the strength and toughness of these materials for potential use in abrasive wear or metal cutting applications.

The metal cutting tests were performed using the alloy materials fabricated into tool inserts ⅜ × ⅜ × ⅛ inch having an 0.030 inch nose radius which was used as a section of the cutting surface. Such radii were ground on the specimens prior to nitriding.

The alloy samples thus prepared were nitrided prior to the cutting tests. For nitriding we used a cold wall furnace employing a molybdenum heating element and radiation shields with the furnace being evacuated to five microns pressure, flushed and filled with nitrogen prior to heating. A slight positive pressure of nitrogen was maintained during nitriding. Temperatures were measured with an optical pyrometer, namely a Leeds and Northrup Optical Pyrometer, catalog number 862, sighting on an unnitrided molybdenum heating element which completely surrounded the specimens. The temperatures given herein are corrected from this source. We used a correction factor determined by using a tungsten-rhenium thermocouple in conjunction with the sightings of the aforesaid optical pyrometer.

Following nitrided sample preparation, lathe turning tests were run on AISI 4340 steel having a hardness of Rockwell C (Rc), 44. A feed rate of 0.005 inch per revolution and depth of cut of 0.050 inches were used. A standard negative rake tool holder was employed with a 5° back rake and a 15° side cutting edge angle.

Our principal criterion in determining the metallic compositional limits of the nitrided materials of this invention is the ability to remove two cubic inches of hardened steel at a speed of 750 SFM (surface feet per minute) when adequately nitrided and used as a single point cutting tool. Within such compositions there is also utility for other cutting applications which do not require the capacity to meet such criterion and with these lower nitrogen levels may be employed. Furthermore, we evaluated the toughness and chipping resistance by using conical diamond hardness indentation (standard Rockwell A scale — 60 kg load) and determined whether chipping occurred around the hardness impression using a 10X eyepiece magnifier. All of our present materials which fall within the scope hereof pass the 750 SFM cutting test and do not exhibit gross chipping around the Ra hardness indentations.

DESCRIPTION OF THE INVENTION

A number of alloys falling within the scope of the herein defined compositional limits have been nitrided and the resulting materials shown in Table I cut the hardened steel at 750 SFM. All said materials are surface hardened and graded.

By the term "graded" as used in the present specification and claims regarding nitride formation we mean that there is a lessening of metal nitride and thus concentration without a sharp transition as one moves inwardly from the surface. In our materials there is not present a thick, continuous nitride phase at the surface with distinct boundaries, but the nitrided zone grades inwardly.

Upon nitriding the present alloy materials a composite structure having a variety of hard, precipitated nitrided phases is formed at the surface which structure grades inwardly depending upon the degree of nitriding. Metallographic lineal analysis of cross sections of our nitrided materials performed conveniently at magnifications of 100 to 2000 X show that there is a minimum of 50% of the hard, precipitated phase at the effective cutting surface. This may be expressed as 50 volume percent. The relative hardness difference between the hard precipitated phase and the matrix will depend upon alloy composition and degree of nitriding.

Certain of the nitrided alloy compositions along with the nitriding treatments therefor, falling within the scope hereof are set out in Table I. This could be written as a series of examples and should be considered as such. These materials pass the cutting and chipping-resistance test criteria set out above. All of these test specimens were of the size ⅜ × ⅜ × ⅛ inch; all picked up more than 1 mg nitrogen/cm² of surface area. Even more nitrogen pick up can be had than is shown in the Table.

We would further note that when elemental columbium and vanadium were nitrided such materials failed to cut the hardened steel at 750 SFM and exhibited brittleness.

TABLE I

| COMPOSITION (Weight %) | NITRIDING TREATMENT Temperature (° F) | Time (Hrs) | Weight Pick-up mg N/cm² |
|---|---|---|---|
| Cb-5Hf-5Mo | 3050 | 4 | 18 |
| Cb-13Hf-13Mo | 2850 | 4 | 8 |
| Cb-30Hf-5Mo | 2850 | 4 | 9 |
| Cb-5Hf-30Mo | 3050 | 2 | 8 |
| Cb-35Hf-10Mo | 2850 | 2 | 5 |
| Cb-20Hf-20Mo | 2850 | 2 | 6 |
| Cb-13Hf-13W | 2850 | 4 | 8 |
| Cb-30Hf-15W | 3050 | 2 | 11 |
| Cb-25Hf-20W | 2850 | 4 | 8 |
| Cb-10Hf-35W | 3050 | 2 | 8 |
| V-20Hf-20W | 2450 | 2 | — |
| Cb-20Ta-10V-20Hf-10Mo-5W | 2850 | 2 | — |
| Cb-20Hf-20Re | 2850 | 4 | 8 |
| Cb-20Hf-10Cr | 2250 | 2 | 5 |
| V-20Hf-20Cr | 2450 | 2 | — |
| Cb-15Hf-5Ti-15Mo | 2850 | 4 | 8 |
| Cb-10Hf-10Ti-25W | 2850 | 2 | 8 |
| V-15Hf-5Ti-15Mo | 2450 | 2 | 10 |
| Cb-15Hf-5Zr-15Mo | 2850 | 4 | — |
| Cb-15Hf-5Ti-20Re | 3050 | 4 | — |
| Cb-15Hf-5Ti-10Mo-8Cr | 2450 | 2 | 5 |
| Cb-10Ti-5Hf-15Mo | 3250 | 2.5 | 22 |
| Cb-15Ti-5Hf-35Mo | 3250 | 2.5 | 12 |
| Cb-20Ti-10Hf-20Mo | 3050 | 2 | 15 |
| Cb-20Ti-10Hf-20W | 3250 | 2 | 22 |
| Cb-25Ti-5Hf-20W | 3250 | 2.5 | 23 |
| Cb-20Ti-15Hf-20W | 3250 | 2.5 | 25 |
| Ta-21Ti-5Hf-10Mo | 3050 | 2 | 15 |
| V-20Ti-10Hf-20W | 2450 | 2 | 8 |
| Cb-15Zr-10Hf-15Mo | 2850 | 4 | — |
| Cb-15Zr-10Hf-20W | 3050 | 2 | 11 |
| Cb-20Zr-15Hf-20W | 2850 | 4 | 8 |
| Ta-15Zr-10Hf-15W | 2850 | 4 | 9 |
| Cb-20Ta-20V-7Ti-7Zr-7Hf-5Mo-5W | 2450 | 4 | 9 |
| Cb-20Ta-20V-7Ti-7Zr-7Hf-5Mo-5W | 3050 | 2 | — |
| Cb-20Ti-5Hf-20Re | 3250 | 2.5 | 24 |
| Cb-20Zr-5Hf-20Re | 3050 | 2 | — |
| Cb-20Ti-5Hf-10Cr | 2450 | 2 | 11 |
| Cb-20Ti-5Hf-10Mo-10Cr | 2650 | 2 | 9 |

We next wish to consider in some detail the various species and subspecies of our invention.

The compositional range of one of said species which contains no titanium and/or zirconium is illustrated in FIG. 1.

In the Cb-Hf-Mo system the nitrided columbium-rich compositions within our invention fall in the range of 55% to 92% columbium, 5% to 40% hafnium, and 2% to 40% molybdenum. Six materials nitrided at 2850° or 3050° F distributed through this compositional range are given in Table I. The nitrided composition Cb-5Hf-5Mo showed propensity towards chipping as evidenced by the cutting tests and the Ra hardness impressions. However, this nitrided composition cuts at 750 SFM and is useful in lighter cutting. It is quite superior to nitrided unalloyed columbium which fails immediately in cutting at 750 SFM. The preferred compositions having improved toughness and cutting capability have columbium in the range of from 55% to 85%.

The difference in hardening in ⅛ inch thick samples between nitrided columbium and various nitrided materials falling within our invention is shown in Table II. Such microhardness readings were obtained on the flat surfaces of metallographically polished cross sections using a 50 gram load at 0.5 mil and a 200 gram load at from 1 to 8 mils from the surface. Although the hardness at the outer surface is similar in all of the nitrided materials and in all is higher than the hardness of commercial sintered carbide, the difference between the grading and therefore the support of the hard surface as between nitrided elemental columbium and the materials of our invention is evident from Table II. For the ⅛ inch cutting tool materials falling within our invention, the 25 gram load microhardness measured on a cross sectional traverse in a zone between the surface and a depth of 0.5 mil is at least 1000 DPN and the hardness grades inwardly in a mostly continuous fashion.

TABLE II

| Distance from Surface (Mils) | Unalloyed Cb Nitrided 3250° F 2 Hours | M crohardness (DPN) Cb-13Hf-13Mo Nitrided 3050° F 2 Hours | Cb-15Hf-5Ti-10Mo-8Cr Nitrided 2450° F 2 Hours | Cb-20Ti-20Hf-20W Nitrided 3250° F 2 Hours |
|---|---|---|---|---|
| 0.5 | 2715 | 2540 | 2860 | 2660 |
| 1 | 2390 | 1740 | 1500 | 1280 |
| 2 | 265 | 1205 | 835 | 790 |
| 4 | 300 | 660 | 500 | 690 |
| 8 | 280 | 565 | 425 | 585 |

Alloys of the compositions Cb-30Hf-30Mo and Cb-50Hf-20Mo, excluded from the scope hereof exhibited brittleness. Both of these alloys in the unnitrided arc melted state fractured during cutting with an abrasive cut off wheel.

The opportunity to directly form the metallic alloys by various metalworking procedures, machining, or powder metallurigal processing prior to nitriding is of obvious advantage since competitive materials such as sintered carbide must be ground to final shape in the hardened form. For example, Cb-30HF-5Mo was hammer forged to a 30% reduction in the thickness at room temperature. The alloys of this species falling within the scope hereof are particularly fabricable when the ratio of hafnium content to total molybdenum and/or tungsten content is greater than 1. Accordingly, a very preferred range of the such materials is as follows:

from 55% to 85% columbium, vanadium (tantalum)
from 7.5% to 40% hafnium;
from 2% to 22.5% molybdenum and/or tungsten; and
wherein the ratio Hf/Mo+W is greater than 1.

Similar findings were noted when tungsten was substituted for the molybdenum. Four Cb-Hf-W compositions are presented in Table I which are within the range of 55% to 92% columbium and which cut at 750 SFM.

Nitrided vanadium based material showed similar results. V-20Hf-20W cut at 750 SFM and no chipping was observed around the Ra hardness impression. This composition was successfully nitrided at a temperature 400° F lower than that generally employed for the columbium compositions. V-50Hf-20W falling outside our invention was brittle as melted and fractured during cutting.

These metals columbium, vanadium, hafnium, molybdenum and tungsten may be combined and up to half of total columbium-vanadium may be replaced by tantalum. For example, 35Cb-10V-20Ta-20Hf-10Mo-5W was nitrided at 2850° F and passed our test criteria.

We have also employed rhenium and chromium as ternary additions to nitrided columbium or vanadium alloys containing hafnium as shown in Table I. Unlike molybdenum and tungsten, rhenium an chromium are commercially electroplated and thus may find utility as electroplated and subsequently diffused surface alloyed products prepared prior to nitriding. Of course, other surface alloying techniques may also be employed for any of the metallic elements hereof. This may be particularly significant for elements such as rhenium and hafnium which are available in relatively limited quantities.

In nitrided materials of this species the chromium-containing compositions show greater chipping propensity as measured both by cutting tests and the Ra hardness impressions. Therefore, the chromium contents of our materials have been limited to 20%. The nitrided materials containing chromium may be nitrided for equivalent times at 2250° F—a temperature substantially below that required for cutting at 750 SFM as compared to compositions containing molybdenum or tungsten.

All of the eight metals described herein as part of this species readily interalloy and nitrided materials within the ranges prescribed below may be prepared containing three to eight metallic constituents. We recognize that restricted amounts of other metallic or metalloid elements may also be added, and that certain limited amounts of impurities may be present.

We now turn to a second species of our invention. In such species we find that titanium and/or zirconium is included with hafnium within similar ranges and that the hafnium content must be equal to or greater than the combined titanium and zirconium content.

The metallic constituents of the materials of this species also readily interalloy and are:

a. at least one metal of the group columbium and vanadium, with up to half thereof being replaceable by tantalum and the content ranges from 55% to 85%;

b. hafnium combined with titanium and/or zirconium wherein the hafnium content must be equal to or greater than the total titanium and zirconium content, and the total ranges from 10% to 40%;

c. at least one metal of the group molybdenum, tungsten, rhenium and chromium ranging from 2% to 40% except that maximum chromium is 20%.

The difference in hardening in ⅛ inch thick samples between nitrided columbium and nitrided Cb-15Hf-5Ti-10Mo-8Cr, one of the materials of this species is shown in Table II.

Nitrided Cb-15Hf-5Ti-15Mo, Cb-10Hf-10Ti-25W, and Cb-15Hf-5Zr-15Mo are examples of columbium base materials falling within this range. Vanadium base materials are also shown in Table I. As shown in Table I, rhenium and chromium additions may also be made. Of the Group II metals here also chromium has the greatest embrittling effect and therefore chromium additions have been limited to 20% maximum.

Similarly, here the opportunity to directly form the metallic alloys by various metalworking procedures, machining, or powder metallurgical processing prior to nitriding is of obvious advantage since competitive materials such as sintered carbide must be ground to final shape in the hardened form. In order to provide the best fabricability of the alloys prior to nitriding we prefer that such alloys contain from 2% to 20% molybdenum and/or tungsten of this Group.

Surface alloying techniques may be employed for any of the metallic elements hereof. This may be particularly significant for elements rhenium and hafnium, available in relatively limited quantities (as noted above) and we recognize that restricted amounts of other metallic or metalloid elements may also be added, and that certain limited amounts of impurities may be present.

Figure 2:
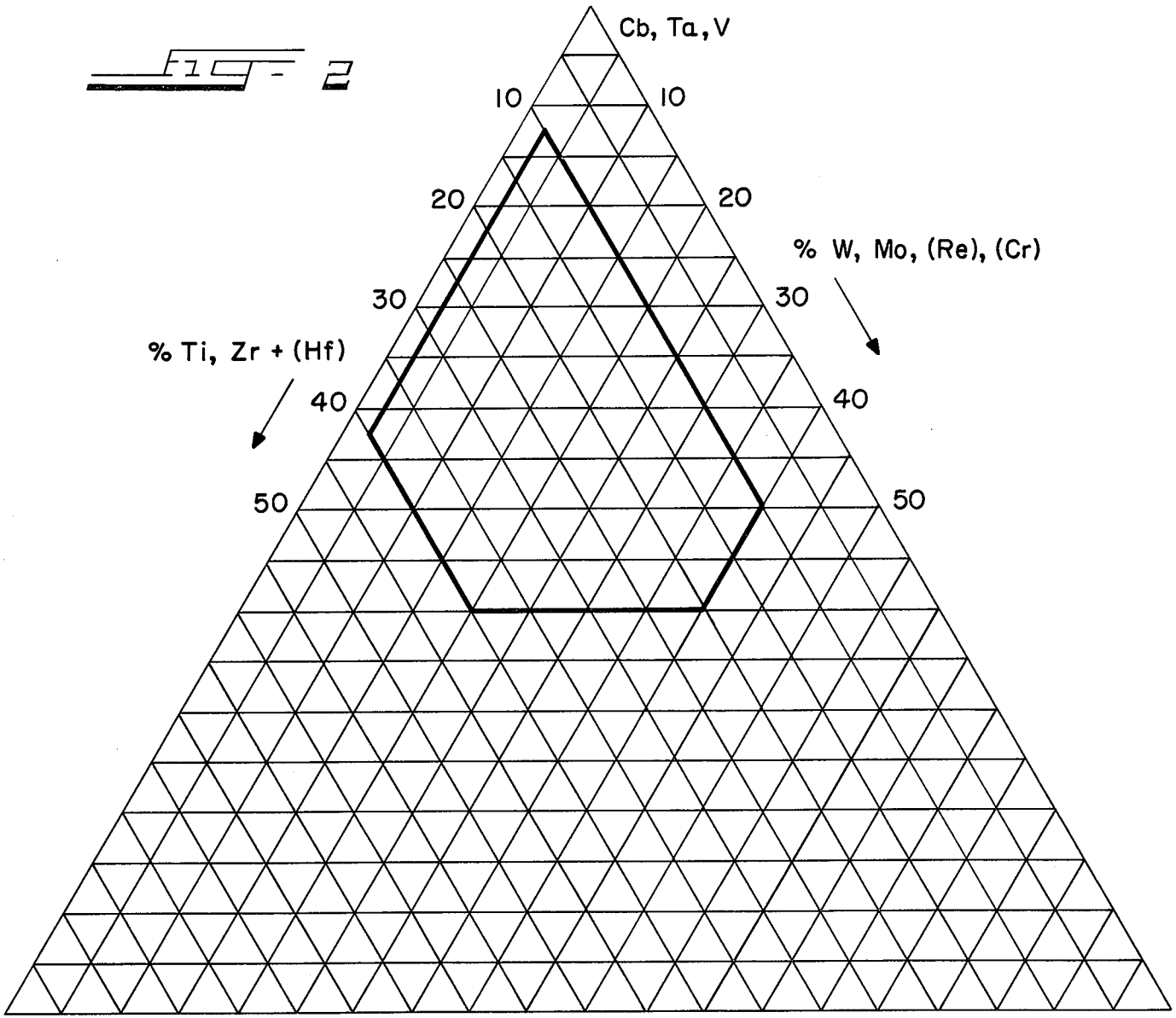
FIG. 2 is a ternary diagram of another composition species useful herein. Regarding such species the claimed materials fall within the polygon shown in the drawing, except for the alloying compositional limitations set out in this specification in which case smaller areas are defined but which fall within the confines of the larger polygon of the Figure.

We wish to turn next to another species hereof which is somewhat more complex compositionally than the previous two. The compositional range of such species is illustrated in FIG. 2.

The alloys used in such species consist essentially, with more specific compositional limits being considered below, of:

a. from 40% to 88% of one or more metals of the Group Cb, Ta, V;

b. from 5% to slightly less than 20% hafnium;

c. such an amount of titanium and/or zirconium wherein total Hf, Ti and/or Zr ranges from 10% to 40% with hafnium content being less than combined Ti and/or Zr; and d. from 2% to 40% of one or more Group II metals.

Representative Cb-Ti-Hf-Mo nitrided materials of such species are shown in Table I. Nitrided Cb-10Ti-5Hf-15Mo, Cb-15Ti-5Hf-35Mo and Cb-20Ti-10Hf-20Mo pass the test criteria and are included within our invention. The tool wear on Cb-10Ti-5Hf-15Mo and Cb-20Ti-10Hf-20Mo was 0.007 and 0.006 respectively.

Tungsten has been shown to be an effective addition. Three nitrided Cb-Ti-Hf-W materials at the 20% tungsten level with 30% to 35% combined titanium and hafnium content and varying Ti/Hf ratios all greater than one passed the test criteria and are part of our invention. Nitrided Cb-Ti-Hf-Mo and Cb-Ti-Hf-W alloys containing high amounts of titanium such as the compositions Cb-65Ti-10Hf-5Mo and Cb-70Ti-5Hf-10W nitrided at 3050° F for either 2 or 4 hours fail to pass at 750 SFM and are excluded from our invention.

The difference in hardening in ⅛ inch thick samples between nitrided columbium and nitrided Cb-20Ti-10Hf-20W, one of the materials falling within this species is shown in Table II.

Examples of nitrided materials of this species containing tantalum and vanadium falling within our invention are also given in Table I. Nitrided Ta-21Ti-5Hf-10Mo and V-20Ti-10Hf-20W both pass the 750 SFM test and show low tool wear, 0.006 and 0.005 inch, respectively. For similar hardening and cutting performance, the vanadium composition was nitrided at 2450° F for 2 hours, a temperature 600° F below that employed for the columbium and tantalum materials. Ta-70Ti-5Hf-10W nitrided at 3050° F for 2 or 4 hours fails to cut at 750 SFM and such composition is not included in our invention. The compositional ranges for nitrided V-Ti-Hf-Mo and V-Ti-Hf-W alloys falling within our invention are the same as the limits for the respective columbium materials.

Upon nitriding of selected zirconium containing quaternary alloys, a high volume of hard phase is developed at the surface accompanied by high surface hardness and grading inwardly is again noted. Three examples of nitrided Cb-Zr-Hf-Mo and Cb-Zr-Hf-W compositions that pass our test criteria and are included in our invention are given in Table I. Hafnium was added to a zirconium-rich composition Cb-70Zr-5Hf-10W nitrided at 3050° F for 2 or 4 hours and the resulting material failed to cut at 750 SFM and is excluded from our invention. Ta-15Zr-10Hf-15W nitrided at 2850° F for 4 hours passed the 750 SFM test with low tool wear and is included within the scope hereof.

The allowed compositional ranges for the nitrided materials containing columbium or tantalum with zirconium plus hafnium, and molybdenum or tungsten are the same as the ranges for the corresponding systems containing titanium plus hafnium.

The eight elements used in our examples heretofore readily interalloy and similar graded nitrided materials may be produced containing more than four metallic constituents. For example, Cb-20Ta-20V-7Ti-7Zr-7Hf-5Mo-5W was nitrided at 2450° for 4 hours, passed the 750 SFM cutting test and such materials are included within our invention.

Again we recognize that restricted amounts of other metallic or metalloid elements may also be added and that certain limited amounts of impurities may be present.

Rhenium and chromium have also been added to the nitrided materials containing titanium and hafnium or zirconium and hafnium. Cb-20Ti-5Hf-20Re nitrided at 3250° F for 2.5 hours and Cb-20Zr-5Hf-20Re nitrided at 3050° F for 2 hours cut at 750 SFM with very low tool wear (0.003 inch). Chromium was added alone or in conjunction with molybdenum. Cb-20Ti-5Hf-10Cr nitrided at 2450° F for 2 hours and Cb-20Ti-5Hf-10Mo-10Cr nitrided at 2650° F for 2 hours both cut at 750 SFM. The chromium containing materials may be nitrided at lower temperatures than the counterpart compositions containing molybdenum, tungsten or rhenium for equivalent hardening and cutting ability. Such compositions containing rhenium and chromium are within our invention but we prefer to use molybdenum or tungsten.

As regards this species certain formulae and ratios are used. These have the following meanings:

Group I consists of columbium, tantalum and vanadium and mixtures thereof;

Group II consists of tungsten, molybdenum, rhenium and chromium and mixtures thereof and wherein $$A = \frac{Cb}{Cb + Ta + V}$$

$$B = \frac{Ta}{Cb + Ta + V}$$

$$C = \frac{V}{Cb + Ta + V}$$

$$D = \frac{Ti}{Ti + Zr + Hf}$$

$$E = \frac{Zr}{Ti + Zr + Hf}$$

$$F = \frac{Hf}{Ti + Zr + Hf}$$

-continued $$K = \frac{Cr}{W + Mo + Re + Cr}$$

where the elemental symbols represent the weight percentage of that element in the alloy.

The nitrided compositions of this species of our invention are given (in weight percentages) by the following:

a. minimum Group I content is 40%;
b. maximum Group I content is 88% provided that chromium is absent and that both vanadium and zirconium are absent;
c. when chromium is present or when both vanadium and zirconium are present, maximum Group I content is given by the relationship $[1 - K][88(D+F+EA+EB) + 75EC] + 85K$;
d. minimum content of hafnium with titanium and/or zirconium is 10% and the maximum content thereof is $40A + 35B + 40C$;
e. hafnium content is less than the combined content of titanium and/or zirconium and ranges from 5% to slightly less than 20%;
f. minimum Group II content is 2% when both vanadium and zirconium are absent;
g. when both vanadium and zirconium are present, minimum Group II content is set by the relationship that the ratio of total hafnium with titanium and/or zirconium to Group II content is $17.5(A+B+CD+CF) + 3CE$;
h. maximum content of Group II metals is 40% and:
   i. maximum tungsten is 40%;
   ii. maximum molybdenum is 40%;
   iii. maximum rhenium $= 40A + 40B + 20C$
   iv. maximum chromium $= 20A + 10B + 40C$ A variety of nitrogen containing environments can be used to produce similar hardened materials. However, upon reacting in a much lower nitrogen potential environment, the effect of lowered nitrogen availability is observed and a somewhat modified reaction product may be obtained. Since our surface reacted composites are in a thermodynamically metastable condition, those skilled in the art will realize that a variety of heat treatments, including multiple and sequential treatments, can be used to modify the reaction product and resulting properties whether performed as part of the over-all nitriding reaction or as separate treatments. The materials can also be nitrided at higher temperatures (and times) that normally would produce some embrittlement and then subsequently annealed in inert gas or various partial pressures of nitrogen as a tempering or drawing operation to improve toughness. This duplex treatment results in a deeper reaction product with the hardness-toughness relationship controlled by the tempering temperature and time.

In practicing the teachings of our invention, from the foregoing it should be borne in mind that nitriding times and temperatures are variable over a considerable range. Generally, for cutting tool uses we nitride for around 2 hours at the temperatures shown as useful in Table I.

As noted above in addition to nitriding alone we can modify our nitrided material by combining nitriding with a very modest amount of oxidizing or boronizing. However, the amount of reaction with such other hardening agents must be limited, a majority of the weight pick-up is due to nitriding, and these are essentially nitrided materials. The alloys may be preoxidized at a temperature where little reaction would occur with nitrogen alone and then subsequently nitrided. Also, the alloys may be reacted with a combined oxidizing and nitriding environment although the relative oxidizing potential must be low since for example in air the alloys will preferentially oxidize rather than nitride. Up to 25% of the nitrogen pick-up by weight may be replaced by oxygen and/or boron.

The present useful alloys may be produced by powder processing techniques in addition to the treatment of solid metal stock as described above. Furthermore, such alloys may be employed on another metal or alloy as a surface coating or cladding or selected components may be diffused in the materials and with the proper selection, a highly ductile or essentially unreacted substrate can be thus obtained. For example, columbium or tantalum are much less reactive to nitrogen when used in conjunction with the alloys and molybdenum is essentially inert to nitrogen. Spraying and/or fusing the desired alloy onto the surface are included in the various coating methods available. Small other additions may be made to our alloys to enhance the coatability. A variety of direct deposition methods may be employed or alternate layers could be deposited followed by a diffusion annealing treatment. Our reactive alloys could be fused on unalloyed molybdenum or other substrates prior to nitriding. The nitrided material can be used as a mechanically locked insert or it can be bonded or joined by brazing, for example, to a substrate.

The high surface hardness of the nitrided materials has been measured by 25, 50 and 200 gram diamond pyramid microhardness traverses on metallographically-polished cross sections. For the ⅛ inch thick materials falling within our invention the 25 gram load hardness measured on a cross sectional traverse in a zone between the surface and a depth of 0.5 mil is generally in the range of 1000 to 3000 DPN and the hardness grades inwardly in a mostly continuous fashion. The nitrogen pick-up is in excess of 1 mg per sq. cm for all of the examples shown in Table I. However, the amount of nitrogen required for an equivalent surface hardness is substantially reduced when the material is used as a thin blade edge or sheet or as a thin coating or cladding. Thus, in certain applications, the nitrogen pick-up may be 0.1 to 1 mg per sq cm of surface area.

Although the alloys receptive to nitriding can be produced by coating or surface alloying techniques, many uses involve the forming and machining of a homogeneous alloy. One of the advantages in utility of these materials is our ability to form the metallic alloys by cold or hot working and/or to machine (or hone) to shape in the relatively soft condition prior to final nitriding. In order to provide the best fabricability of the alloys prior to nitriding we prefer that such alloys contain from 2% to 25% molybdenum and/or tungsten of this Group. Only minimal distortion occurs during nitriding and replication of the starting shape and surface finish is excellent. The final surface is reproducible and is controlled by original surface condition, alloy composition, and nitriding treatment. For some applications, the utility would be enhanced by lapping, polishing or other finishing operations before or after nitriding. The nitrided surface is quite hard but only a small amount of material removal is required to produce a highly finished surface. We have noted the excellent thermal shock resistance, and corrosion resistance of the present nitrided materials.

In the foregoing disclosure we have described nitrided materials which are excellent single point cutting tools for metal cutting. For this purpose the described tool inserts having substantially more than 1 mg N/cm$^2$ were used. Where a homogeneous alloy substrate, nitrided, is employed as a metal cutting tool it is preferred to have a nitrogen pick-up of at least 5 mg/cm$^2$. This is shown in Table I. It will of course be recognized that such materials also may be used for other types of cutters such as knife blades, razor blades, scrapers, reamers, drills, needles and various multiple point cutters.

It will be understood that various modifications and variations may be effected without departing from the spirit or scope of the novel concepts of our invention.

We claim as our invention:

1. A graded, nitrided cutting tool material having a nitrogen pickup of at least 0.1 milligram per square centimeter of surface area with the nitrided concentration lessening inwardly from the surface, having excellent cutting and abrasion resistant properties consisting essentially of by weight:

a. from 55% to 85% of a metal selected from the group consisting of columbium, vanadium and mixtures thereof;
b. from 10% to 40% of a metal selected from the group consisting of hafnium, titanium, zirconium, and mixtures thereof, and wherein both hafnium and at least one metal of the group titanium and zirconium is present;
c. hafnium content is equal to or greater than the content of titanium, zirconium and mixtures thereof;
d. hafnium content ranges from 5% to 35%; and
e. the minimum content of a metal selected from the group consisting of titanium, zirconium and mixtures thereof is 5%.

2. A graded, nitrided cutting tool material having a nitrogen pickup of at least 0.1 milligram per square centimeter of surface area with the nitrided concentration lessening inwardly from the surface, having excellent cutting and abrasion resistant properties consisting essentially of by weight:

a. from 10% to a maximum value established by the relationship (40A + 35B + 40C) of a metal selected from the group consisting of hafnium, titanium, zirconium and mixtures thereof and wherein both hafnium and at least one metal of the group titanium and zirconium is present;
b. hafnium content is less than the content of titanium, zirconium and mixtures thereof;
c. hafnium content ranges from 5% to less than 20%;
d. from 40% to 92% of a metal selected from the group consisting of columbium, vanadium and mixtures thereof;
e. when chromium, vanadium and zirconium are absent the maximum columbium content is 88%;
f. when chromium is present or when both vanadium and zirconium are present the maximum content of a metal selected from the group consisting of columbium, vanadium and mixtures thereof is given by the expression $$[1 - K]\,[88\,(D+F+EA+EB) + 75EC] + 85K;$$

g. when both vanadium and zirconium are present the minimum content of a metal selected from the group consisting of molybdenum, tungsten, rhenium, chromium and mixtures thereof is set by the ratio that the total of hafnium, titanium and zirconium to total such group content is 17.5(A+B+CD+CF) + 3CE;

h. when tungsten is present its maximum content is 40%;

i. when molybdenum is present its maximum content is 40%;

j. the maximum rhenium is given by the expression 40A + 40B + 20C;

k. the maximum chromium content is given by the expression 20A + 10B + 40C; and wherein:

in the foregoing in weight percent concentrations $$A = \frac{Cb}{Cb + Ta + V}$$

$$B = \frac{Ta}{Cb + Ta + V}$$

$$C = \frac{V}{Cb + Ta + V}$$

$$D = \frac{Ti}{Ti + Zr + Hf}$$

$$E = \frac{Zr}{Ti + Zr + Hf}$$

$$F = \frac{Hf}{Ti + Zr + Hf}$$

$$K = \frac{Cr}{W + Mo + Re + Cr}.$$

3. The cutting tool material as defined in claim 1 wherein the nitrogen pick-up is at least 1.0 milligram per square centimeter of surface area.

4. The cutting tool material as defined in claim 1 wherein up to 25 percent of the nitrogen is replaced by oxygen, boron and mixtures thereof.

5. The cutting tool material as defined in claim 1 wherein the alloy contains from 2% to 40% of molybdenum and tungsten and mixtures thereof.

6. The cutting tool material as defined in claim 1 wherein the hardness in the surface zone thereof is at least 1000 DPN and which material, when appropriately nitrided, is characterized by being able to remove at least two cubic inches of steel hardened to Rockwell C 44 at a cutting speed of 750 surface feet per minute.

7. The cutting tool material as defined in claim 1 wherein the nitrogen pick-up is at least 5 milligrams per square centimeter of surface area.

8. The cutting tool material as defined in claim 1 wherein of its group only columbium is present, of its group only molybdenum, tungsten and mixtures thereof are present and in amounts ranging from 2% to 25%, and the nitrogen pick-up is at least 1.0 milligram per square centimeter of surface area.

9. The cutting tool material as defined in claim 2 wherein the nitrogen pick-up is at least 1.0 milligram per square centimeter of surface area.

10. The cutting tool material as defined in claim 2 wherein up to 25 percent of the nitrogen is replaced by oxygen, boron and mixtures thereof.

11. The cutting tool material as defined in claim 2 wherein the alloy contains from 2% to 40% of molybdenum and tungsten and mixtures thereof.

12. The cutting tool material as defined in claim 2 wherein the hardness in the surface zone thereof is at least 1000 DPN and which material, when appropriately nitrided, is characterized by being able to remove at least two cubic inches of steel hardened to Rockwell C 44 at a cutting speed of 750 surface feet per minute.

13. The cutting tool material as defined in claim 2 wherein the nitrogen pick-up is at least 5 milligram per square centimeter of surface area.

14. The cutting tool material as defined in claim 2 wherein of its group only columbium is present, of its group only molybdenum, tungsten and mixtures thereof are present and in amounts ranging from 2% to 25%, and the nitrogen pick-up is at least 1.0 milligram per square centimeter of surface area.

* * * * *